US010365013B1

(12) United States Patent
Wieckowski et al.

(10) Patent No.: US 10,365,013 B1
(45) Date of Patent: Jul. 30, 2019

(54) FLUID HEATER WITH FINITE ELEMENT CONTROL

(71) Applicant: Heatworks Technologies, Inc., Sullivan's Island, SC (US)

(72) Inventors: Michael J. Wieckowski, Charleston, SC (US); Weston Scott Catron, Mount Pleasant, SC (US); Jeremiah M. Callahan, Sullivan's Island, SC (US)

(73) Assignee: Heatworks Technologies, Inc., Sullivans Island, SC (US)

( * ) Notice: Subject to any disclaimer, the term of this patent is extended or adjusted under 35 U.S.C. 154(b) by 0 days.

(21) Appl. No.: 15/952,832

(22) Filed: Apr. 13, 2018

(51) Int. Cl.
*F24H 1/10* (2006.01)

(52) U.S. Cl.
CPC ..... *F24H 1/106* (2013.01)

(58) Field of Classification Search
CPC ..... F24H 1/106; H05B 3/60; H05B 2203/021
USPC ..... 219/483, 485, 497; 392/311, 314, 411, 392/486, 497
See application file for complete search history.

(56) References Cited

U.S. PATENT DOCUMENTS 2,680,802 A 6/1954 Bremer et al.
4,692,592 A * 9/1987 Kale ..... F24H 1/202 392/450
5,866,880 A 2/1999 Seitz et al.
6,080,971 A * 6/2000 Seitz ..... F24H 9/2028 219/483
6,130,990 A * 10/2000 Herrick ..... H05B 3/60 392/312
6,246,831 B1 * 6/2001 Seitz ..... F24H 9/2021 219/483
6,389,226 B1 * 5/2002 Neale ..... F24H 1/102 392/485
6,552,283 B2 * 4/2003 Cabrera ..... H01H 36/02 200/81.9 M (Continued)

FOREIGN PATENT DOCUMENTS

DE 2426196 A1 12/1975
WO 2009100486 A1 8/2009
WO 2014102554 A1 7/2014

OTHER PUBLICATIONS

International Search Report and Written Opinion from PCT/US2019/023611, dated Jun. 11, 2019, pp. 1-11.

*Primary Examiner* — Thien S Tran
(74) *Attorney, Agent, or Firm* — Lerner, David, Littenberg, Krumholz & Mentlik, LLP

(57) ABSTRACT

An ohmic heater for heating a conductive fluid includes electrodes (14) and spaces (20) between the electrodes. A controller (52) selectively connects the electrodes to a power supply (36) during a succession of actuation intervals so as to form conduction paths, each including two live electrodes connected to different electrical potentials, and the fluid in one or more spaces. The controller models fluid passing through the spaces as a series of finite elements moving through the spaces. Before each actuation interval, the controller estimates the expected results of actuating various possible conduction paths, including the estimated temperature of the fluid in the conduction paths and the estimated currents passing through the live electrodes. The controller selects a set of conduction paths for which the estimated results meet a set of constraints, and actuates only the selected conduction paths during the actuation interval.

28 Claims, 5 Drawing Sheets

(56) References Cited

U.S. PATENT DOCUMENTS

| | | | | |
|---|---|---|---|---|
| 6,701,069 | B1 * | 3/2004 | Cezayirli | F24H 1/102 392/490 |
| 6,998,584 | B1 * | 2/2006 | Luo | H05B 1/0236 219/483 |
| 7,050,706 | B2 | 5/2006 | Israelsohn et al. | |
| 7,164,851 | B2 * | 1/2007 | Sturm | F24H 9/2028 219/497 |
| 7,817,906 | B2 | 10/2010 | Callahan et al. | |
| 2006/0291527 | A1 * | 12/2006 | Callahan | F24H 1/106 373/108 |

* cited by examiner

FLUID HEATER WITH FINITE ELEMENT CONTROL

BACKGROUND OF THE INVENTION

The present disclosure relates to ohmic fluid heating devices, and methods of heating a fluid. An ohmic fluid heater can be used to heat an electrically conductive fluid as, for example, potable water. Such a heater typically includes plural electrodes spaced apart from one another. The electrodes are contacted with the fluid to be heated so that the fluid fills the spaces between neighboring electrodes. Two or more of the electrodes are connected to a power supply so that different electrical potentials are applied to different ones of the electrodes. For example, where an ohmic heater is operated using normal AC utility power such as that obtainable from a household electric plug, at least one of the electrodes is connected to one pole carrying an alternating potential, whereas at least one other electrode is connected to the opposite pole. Electricity passes between the electrodes through the fluid at least one space between the electrodes, and electrical energy is converted to heat by the electrical resistance of the fluid.

It is desirable to control the rate at which electrical energy is converted to heat, (the "heating rate"), in such a heater to achieve the desired temperature of the heated fluid. It has been proposed to vary the heating rate by mechanically moving electrodes closer relative to one another, thereby varying the electrical resistance between the electrodes. Such arrangements, however, require complex mechanical elements including moving parts exposed to the fluid. Moreover, it is difficult to make such mechanisms respond quickly to deal with rapidly changing conditions. For example, if an ohmic heater is used in an "instantaneous heating" arrangement to heat water supplied to a plumbing fixture such as a shower head, the water continually passes through the heater directly to the fixture while the fixture is in use. If the user suddenly increases the flow rate of the water, as by opening a valve on the fixture, the heater should react rapidly to increase the heating rate so as to maintain the water supplied to the fixture at a substantially constant temperature.

It has also been proposed to provide an ohmic heater with a substantial number of electrodes and with power switches to selectively connect different ones of the electrodes to the poles of the power supply. For example, an array of electrodes may be disposed in a linear arrangement with spaces between the electrodes. The array includes two electrodes at the extremes of the array and numerous intermediate electrodes between the two extreme electrodes. To provide a minimum heating rate, the extreme electrodes are connected to opposite poles of the power supply, and the intermediate electrodes are isolated from the poles. The electric current passes from one extreme electrode through the fluid in a first space to the nearest one of the intermediate electrodes, then through fluid in the next space to the next isolated electrode and so on until it reaches the last intermediate electrode, and flows from the last intermediate electrode to the other extreme electrode. Thus, the fluid within all of the spaces is electrically connected in series between the two extreme electrodes. This connection scheme provides high electrical resistance between the poles of the power supply and a low heating rate.

For a maximum heating rate, all of the electrodes are connected to the poles so that each electrode is connected to the opposite pole from its next nearest neighbor. In this condition, the fluid in each space is directly connected between the poles of the power supply, in parallel with the fluid in every other space. The connection scheme provides minimum resistance between the poles. Intermediate heating rates may be achieved by connecting various combinations of electrodes to the poles of the power supply. For example, in one such connection scheme, two of the intermediate electrodes are connected to opposite poles of the power supply, and the remaining electrodes are electrically isolated from the poles of the power supply. The connected intermediate electrodes are separated from one another by a few other intermediate electrodes and a few spaces, so that fluid in only a few spaces is connected in series between the poles. This connection scheme provides a resistance between the poles that is higher than the resistance in the maximum heating rate scheme, but lower resistance than the resistance in the minimum heating rate scheme. With fluid having a given conductivity, different connection schemes will provide different resistances between the poles, and thus different heating rates.

Typically, the switches are electrically controllable switches such as semiconductor switching elements as, for example, thyristors. Ohmic heaters of this type can switch rapidly between connection schemes and thus switch rapidly between heating rates. Such heaters do not require any moving parts in contact with the fluid to control the heating rate. Ohmic heaters of this type can only select from among the set of the specific resistances fixed by the physical configuration of the electrodes, and thus the heating rate, in steps. As disclosed in U.S. Pat. Nos. 7,817,906 and 8,861,943, the disclosures of which are hereby incorporated by reference herein, the electrodes of such a heater can be spaced at non-uniform distances from one another to provide a wide range of resistances with fluid of a given conductivity and a large number of steps with substantially uniform ratios of heating rate between steps. As disclosed in International Application PCT/US2017/060192, the disclosure of which is hereby incorporated by reference herein, even more steps of heating rate can be provided with a given number of electrodes by providing shunting switches which can selectively connect certain ones of the electrodes to one another. In heaters of this type, the available switch combinations and the associated heating rates may be stored in a lookup table. Heaters of this type typically have been controlled by a feedback control system which reacts to operating conditions by selecting a higher or lower heating rate. For example, such a heater may include an outlet temperature sensor. If the fluid discharged from the heater is at a temperature below the desired temperature (also referred to as the "set point" temperature), the control system selects a combination of electrodes with a higher heating rate. Heaters of this type can provided effective heating, and can compensate for differences in operating conditions such as differences in flow rate, conductivity, inlet temperature.

However, still further improvement would be desirable.

BRIEF SUMMARY OF THE INVENTION

One aspect of the invention provides a heater for heating an electrically conductive fluid. A heater according to this aspect of the invention desirably includes a structure and a plurality of electrodes mounted to the structure with spaces between neighboring ones of the electrodes. The structure desirably is adapted to direct fluid flowing through the heater in a downstream direction along a predetermined flow path extending through the spaces, so that fluid in the spaces contacts the electrodes and electrically connects neighboring electrodes to one another.

The heater desirably includes an electrical power supply having at least two poles, the power supply being operable to supply different electrical potentials to different ones of the poles. The heater preferably includes power switches electrically connected between the electrodes and the poles, the power switches being operable to selectively connect the electrodes to the poles and to selectively disconnect the electrodes from the poles so as to form conduction paths, each including two live electrodes connected to different poles of the power supply and fluid in at least one of the spaces.

Desirably, the heater according to this aspect of the invention includes a controller configured to control operation of the power switches by cyclically operating a model in which the fluid is modeled as a series of fluid elements passing through the spaces at a speed based on a flow rate of the fluid through the heater. Most desirably each cycle of the model including the steps of:

(i) modeling operation of different ones of the conduction paths during an actuation interval to predict (1) an ending temperature at the end of the actuation interval for each fluid element and (2) a current passing through each live electrode, the predictions being on an estimated beginning temperature and conductivity for each such fluid element at the start of the actuation interval, the modeling step being conducted so as to select those conduction paths which can be actuated during the actuation interval without violating a set of constraints including a maximum ending temperature and maximum current through each live electrode; and (ii) actuating the power switches to connect the only the live electrodes of the selected conduction paths to the power supply at the beginning of the actuation interval;

wherein the estimated beginning temperatures of the fluid elements used in each cycle are determined based at least in part on the ending temperatures for the same fluid elements predicted in a previous cycle.

A further aspect of the invention provides methods of heating a conductive fluid. Other aspects and features of the invention will be apparent from the detailed description set forth below.

DETAILED DESCRIPTION

Figure 1:
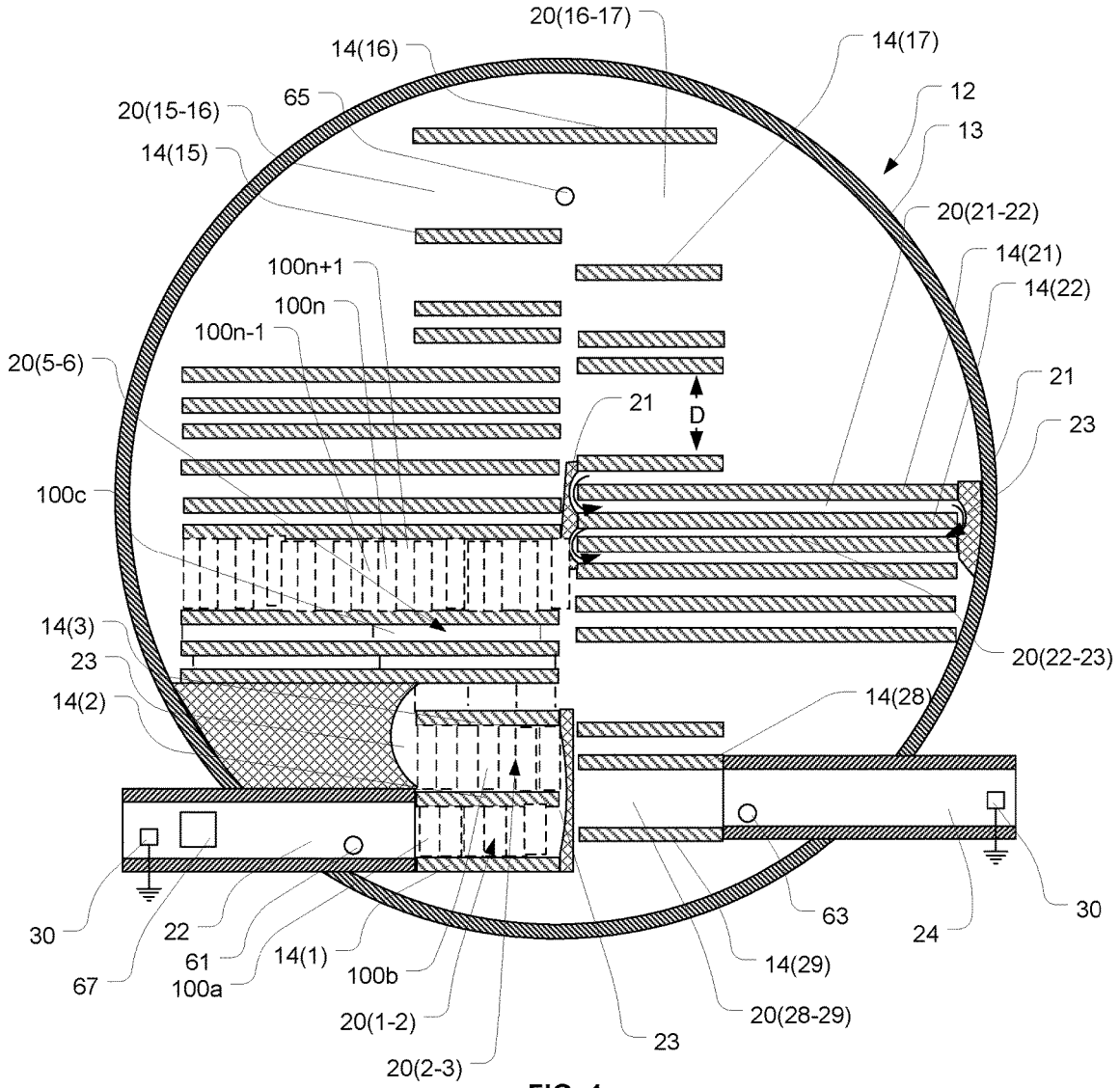
FIG. 1 is a diagrammatic sectional view depicting a heater according to one embodiment of the invention, with some elements omitted for clarity of illustration.

A heater in accordance with one embodiment of the invention (FIG. 1) includes a structure 12 including a hollow housing 13. Electrodes 14 are mounted to the housing. As shown in FIG. 2, each electrode is generally a flat rectangular plate having major surfaces 16 and 18 facing in opposite directions with edge surfaces extending between these major surfaces. The electrodes 14 are mounted in housing 13 so that spaces 20 are defined between neighboring ones of the electrodes. As used in this disclosure with reference to electrodes, the expression "neighboring" means that a continuous space uninterrupted by any other electrode extends between the two neighboring electrodes. The major surfaces of electrodes 14 face one another so that the electrodes are disposed in a stack with the major surface 18 of one electrode facing towards the opposite major surface 16 of the neighboring electrode. The major surfaces of the electrodes in this arrangement are parallel to one another so that the distance between the electrode surfaces bounding each space is uniform over the entire extent of the space. However, in this arrangement the electrodes are non-uniformly spaced from one another. Thus the distance D between at least some pairs of neighboring electrodes is different from the distances between other pairs of neighboring electrodes.

Figure 2:
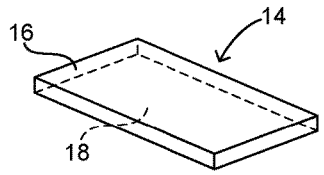
FIG. 2 is a diagrammatic perspective view of an electrode used in the heater of FIG. 1.

In FIG. 1, each electrode 14 has an ordinal number shown in parenthesis next to the reference numeral 14. The ordinal number denotes the position electrode in the stack Thus, electrode 14(1) at one end of the stack; electrode 14(2) is next, and so on, with the last electrode 14(29) disposed at the opposite end of the stack. The stack is folded at electrode 14(16). Each space 20 has an ordinal designation corresponding to the ordinal designation of the two electrodes bounding that particular space. For example, space 20(1-2) is bounded by electrodes 14(1) and 14(2); space 20(2-3) is bounded by electrode 14(1) and electrode 14(2), and so on. Electrode 14(16) has two sections of one major surface. One section faces electrode 14(15) so as to bound space 20(15-16). The other section of electrode 14(16) faces electrode 14(17) so as to bound space 20(16-17).

The electrodes may be formed from any electrically conductive material compatible with the fluid to be heated. For example, where the fluid is water, the electrodes may be formed from materials such as stainless steel, platinized titanium or graphite. The structure forming housing 13 also may include any material compatible with the fluid but should include a dielectric material or materials arranged so that the housing does not form an electrically conduction path between any of the electrodes.

The housing 13 defines an inlet 22 and an outlet 24 connected to the spaces. The electrodes 14 are arranged within housing 13 so that, in cooperation with the structure, they form a continuous flow path between the inlet 22 and the outlet 24. The electrodes and structure are arranged so that fluid passing from the inlet to the outlet will pass through all of the spaces 20 in series, in the order according to the ordinal numbers of the spaces. For example, the structure may include baffles 21, partially depicted in FIG. 1, which define passages 23 connecting the spaces 20 to one another. These passages are arranged so that fluid will pass through the spaces 20 in a serpentine fashion as indicated at spaces 20(21-22) and 20(22-23). The baffles and passages associated with some of the other spaces are omitted for clarity of illustration in FIG. 1. The baffles desirably are formed from a dielectric material and do not electrically connect the electrodes to one another. Ground electrodes 30 optionally may be provided within the inlet and outlet. These ground electrodes desirably are remote from electrodes 14.

Figure 3:
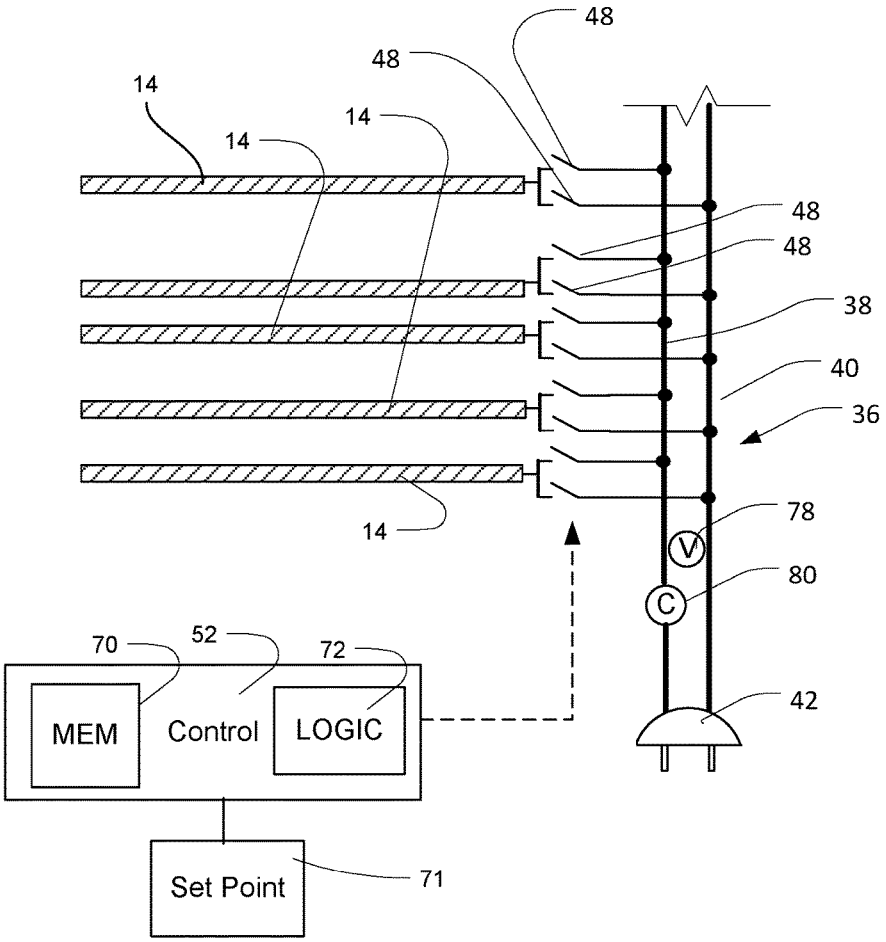
FIG. 3 is a partially block diagrammatic electrical schematic of the heater shown in FIGS. 1 and 2, with some elements omitted for clarity of illustration.

The heater as discussed above with respect to FIGS. 1 and 2 also includes an electrical circuit (FIG. 3). The circuit includes a power supply 36 incorporating two poles in the form of conductors 38 and 40. These conductors are connected to a plug 42 adapted for connection to a source of electrical power such as a utility power socket. Alternatively or additionally, the conductors may be arranged for permanent connection to a circuit carrying utility power. The conductors are arranged so that in operation, different electrical potentials are applied to poles 38 and 40. For example, conductor 40 may be a neutral conductor which receives a neutral voltage, typically close to ground voltage, whereas conductor 38 may be a "hot" conductor which will receive an alternating voltage supplied by an AC power source.

Power switches 48 are connected between the electrodes 14 and power source 36. Power switches 48 are arranged so that each electrode may be connected to either one of poles 38 and 40 or may be left isolated from the poles. Only a few of the electrodes are and power switches are depicted in FIG. 3, the remaining ones being omitted for clarity of illustration. As used in this disclosure, the term "switch" includes mechanical switches which may be actuated by devices such as relays or the like and also includes solid state devices that can be actuated to switch between a conducting condition with very high impedance and an "on" condition with very low impedance. Examples of solid state switches include triacs, MOSFETs, thyristors, and IGBTs. Solid state switches are preferred because they can be actuated rapidly. In the particular arrangement depicted, two individual single pole single throw switches are associated with each electrode, each being operable to connect the associated electrode with a different one of the poles. Each electrode is isolated from both poles when both switches are open. However, this arrangement can be replaced by any other electrically equivalent switching arrangement.

As further discussed below, electrodes 14 which are isolated from the power source 36 by operation of switches 48 may be electrically connected to one or more other electrodes by the fluid in the spaces 20, and the other electrodes may be connected to the poles. Such indirect connections are ignored in determining whether or not an electrode is connected to the poles. Stated another way, as used in this disclosure, a statement that an electrode is connected to a pole of the power supply should be understood as meaning that the electrode is directly connected to the power supply through the power supply switches and associated electrical conductors.

The heater further includes an inlet temperature sensor 61 positioned in the inlet 22 (FIG. 1); an outlet temperature sensor 63 positioned in outlet 24 and one or more intermediate temperature sensors 65 disposed in the flow path emote from the inlet and outlet as, for example, between spaces 20(15-16) and 20(16-17), approximately midway along the flow path. The temperature sensors may be conventional elements as, for example, thermocouples, thermistors or resistors having electrical resistance which varies with temperature. A flowmeter 67 is provided in serial flow relationship with the flow path through the heater as, for example, at inlet 22. The flowmeter also may be a conventional element as, for example, a turbine wheel sensor, an ultrasonic flow meter or a meter adapted to measure a pressure differential between two points along the flow path as, for example, between the inlet 22 and outlet 24. A conductivity measuring instrument is also provided for measuring the electrical conductivity of the fluid passing through the heater. In the embodiment depicted, the conductivity measuring instrument includes the first two electrodes 14(1) and 14(2) of the heater, as well as a current sensor 80 connected in series with one pole 38 of the power supply. As explained below, the control circuit is arranged to momentarily connect electrodes 14(1) and 14(2) to opposite poles of the power supply while leaving all of the other electrodes isolated from the power supply. The current flowing through the power supply in this condition is proportional to the conductivity of the fluid in space 20(1-2) and to the voltage applied by the power supply. This voltage may be assumed to have a specified value, or may be measured by a voltmeter 78 connected between the poles 38 and 40. In other embodiments, the conductivity measuring instrument may include separate electrodes, which may be energized by a separate power supply.

The heater also includes a controller 58 (FIG. 3). The controller includes a logic unit 72 and a memory 70. The logic unit may include a programmable microprocessor, a hard-wired logic circuit, a programmable gate array, or any other logic element capable of performing the operations discussed herein. Although the term "unit" is used herein, this does not require that the elements constituting the unit be disposed in a single location. For example, parts of the logic unit, may be disposed at physically separate locations, and may be operatively connected to one another through any suitable communications medium. The memory desirably includes a non-volatile memory 70 as, for example, a read-only memory ("ROM"), a programmable read only memory or a disc memory which stores instructions configured to actuate the microprocessor to perform the operations discussed below. Memory 70 desirably also stores data representative of the configuration of the heater as, for example, data representing the sizes of the various electrodes; the maximum current ratings of the power switches and the like. Memory 70 desirably also includes a volatile memory such as a random-access memory for storing data such as intermediate results in the operations discussed below. The memory 70 also may include a plurality of physically separate elements interconnected by communication channels.

The logic unit 72 has one or more outputs (not shown) connected to the power switches 48 as, for example, through conventional driver circuits (not shown) arranged to translate signals supplied by the logic unit to appropriate voltages or currents to actuate the switches. The logic unit also has inputs connected to the temperature, current and flow sensors discussed above. A set point input element 71 is connected to the controller for supplying a value of a desired set point temperature, i.e., a desired temperature of fluid passing out of the heater. The set point input element may be a manually-operable device such as a knob or keyboard, or a communication device capable of receiving the desired set point over a communications medium such as the Internet. In a further variant, a fixed set point may be stored in memory as, for example, as part of the instructions stored in memory 72, or may be built in to the controller.

Controller 52 operates a mathematical model of the heater. In this model, the fluid flowing through the heater is modeled as a series of individual fluid elements, each having a predetermined volume. For example, in a heater for domestic water heating, each fluid element may have a volume of 1 cubic centimeter. The model represents the fluid as a series of these elements. Some of the fluid elements 100 are depicted in broken lines in FIG. 1. Each fluid element 100 is modeled as coming into existence at the entrance to the first space 20(1-2) and as moving along the fluid path, through the spaces 20 and passages 23 at a speed which is proportional to the flow rate of fluid through the heater. As further explained below, the controller will actuate the electrodes during a series of brief actuation intervals of fixed duration following immediately after one another. The volumes of the spaces 20 and passages 23 are fixed and known, so that each location along the fluid path corresponds to a known number of fluid elements from the entrance to the first space. The model tracks the locations of the fluid elements at the beginning of each actuation interval. For example, if the model represents a particular fluid element 100*a* as created just before the beginning of a first actuation interval, and the flow rate is such that 10 fluid elements are created during each actuation interval, element 100*a* will be at the location of element 100*b* at the beginning of the next actuation interval. At a higher flow rate, the same fluid element would be at the location indicated at 100*c* in FIG. 1.

The model maintains temperature data for each fluid element. When created, each fluid element has the temperature measured by inlet thermometer 61 at the time the element is created. As further discussed below, the temperature data for each fluid element is updated to represent the effect of power applied during successive actuation intervals. At startup, the model assumes that all of the spaces 20 are filled with a set of fluid elements, and that all of the fluid elements are at the measured inlet temperature. At startup, and periodically thereafter, the controller measures the conductivity of incoming fluid and also measures the temperature of the incoming fluid during the conductivity measurement so as to provide baseline conductivity data. This data, together with a known change in conductivity with temperature for the fluid, is used with the updated temperatures of the various fluid elements to estimate the conductivity of the fluid in each element.

Figure 4:
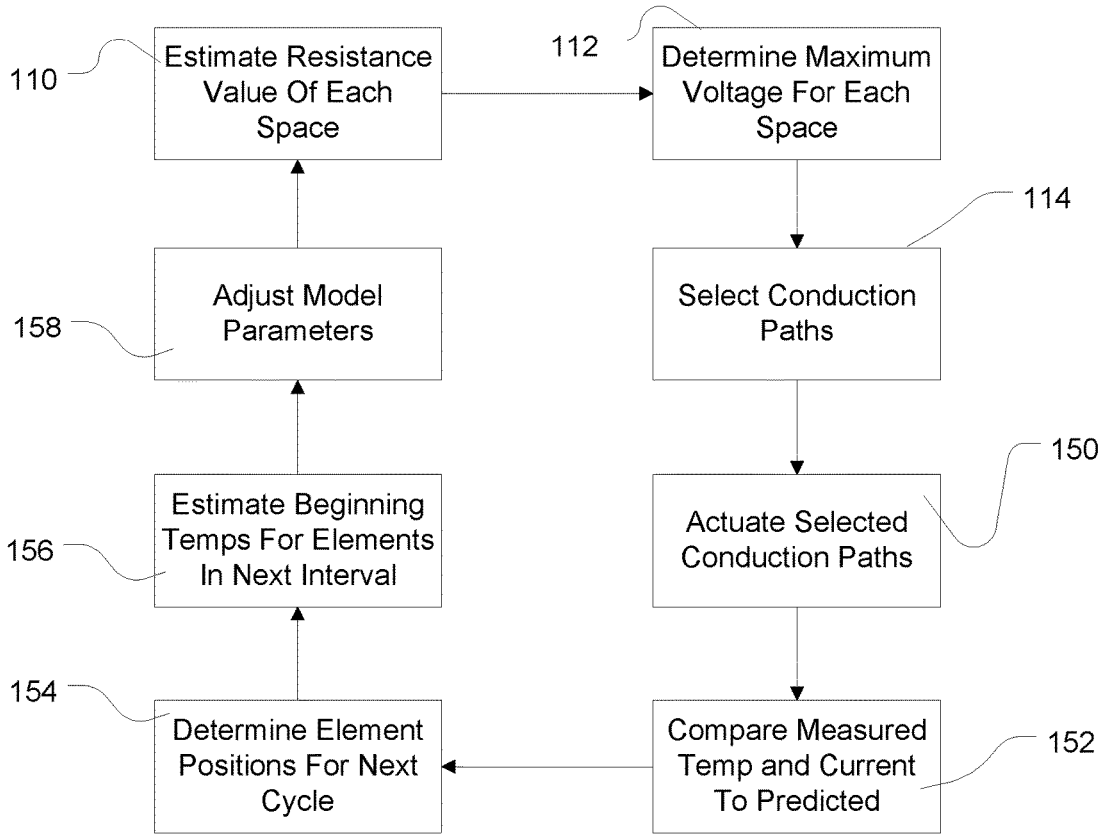
FIG. 4 is flow chart depicting a control process executed in operation of the heater of FIGS. 1-3

The controller operates the model cyclically as depicted in FIG. 4. In step 110, the controller estimates the aggregate electrical resistance or conductance (inverse of the resistance) between the electrodes bounding each space 20 at the beginning of the next actuation interval. This estimate is based on the individual electrical resistances of the fluid elements which will be disposed within the space at the time such when the next actuation interval will begin. The resistance of each fluid element will depend on the estimated conductivity of the fluid element, as well as the distance between the electrodes bounding the space. The estimated conductivity for each fluid element is calculated from the baseline conductivity data and the estimated temperature of each fluid element at the beginning of the actuation interval. The distance between the electrodes determines the length of the current path between the electrodes as well as the cross-sectional area of the fluid element in a plane transverse to the current path. For example, fluid element 100*b* (FIG. 1), disposed in space 20(2-3) between widely spaced electrodes has a relatively long path length and a relatively small cross-sectional area. By contrast, fluid element 100*c*, disposed in space 20(5-6) has a short path length and large cross-sectional area. If both fluid elements have the same conductivity, element 100*c* will have a much lower electrical resistance. Because the space between electrodes is fixed and known, there is a resistance parameter for each space such that the resistance of each fluid element can be calculated by dividing the parameter by the estimated conductivity of that fluid element. The resistance parameters desirably are stored in the memory. The calculation of the estimated resistance of each fluid element may be performed as calculation of the estimated electrical conductance of each fluid element, where conductance is the inverse of resistance. Stated another way, it should be understood that calculation of conductance implicitly calculates resistance, and vice-versa.

The aggregate resistance or conductance between the electrodes bounding each space 20 is calculated from the resistances or conductances of the individual fluid elements in the space in parallel with one another. The aggregate conductance is simply the sum of the conductances of the fluid elements disposed within the space.

In the next step 112 (FIG. 6) the controller determines a maximum voltage which can be applied between the electrodes bounding each space during the next actuation interval without heating any of the fluid elements within that space to a temperature above a maximum temperature. In this embodiment, the maximum temperature is equal to the set point temperature, i.e., the desired temperature of the fluid passing out of the heater. For each fluid element, the maximum voltage which can be applied without heating that element above the maximum temperature is:

$$E\ \max=\sqrt{R\text{element}K1(T\max-T\text{element})} \qquad \text{(Formula 1)}$$

Where:

E max is the maximum voltage which can be applied;

Relement is the estimated electrical resistance of the fluid element at the beginning of the actuation interval;

T max is the maximum temperature;

Telement is the estimated temperature of the fluid element at the beginning of the actuation interval; and

K1 is a constant equal to the specific heat of the fluid multiplied by the mass of the fluid element and divided by the duration of the actuation interval. This constant will be the same for every fluid element.

For most fluids, including domestic water and most or all ionic solutions, conductivity increases with temperature. For such fluids, both Relement and (T max−Telement) decrease as Telement increases. Therefore, for such fluids, the lowest value of E max for any fluid element in a particular space will always be the value of E max for the element having the highest estimated temperature at the beginning of the actuation interval. Thus, in step 112, the controller simply selects the element in each space with the highest estimated temperature and determines the maximum voltage by solving Formula 1 for this element. This determination can be done by explicit calculation or by use of a lookup table having stored values of E max for various combinations of Relement and (T max−Telement).

In the next step 114, the controller selects a set of conduction paths for actuation in the next actuation cycle. The goal of this step is to select a set of conduction paths such that all of the conduction paths meet the following constraints. First, actuation of the conduction paths will not cause heating of any fluid element above the maximum temperature T max discussed above. Second, actuation of the conduction paths will not result in a current flow through any live electrode which exceeds the current capacity of a switch which connects the live electrode to one of the poles of the power supply. Third, actuation of all of the conduction paths in the set will not result in a current flow between the poles of the power supply in excess of a predetermined maximum total current which is typically set at or slightly below the rated capacity of the power supply.

Figure 5:
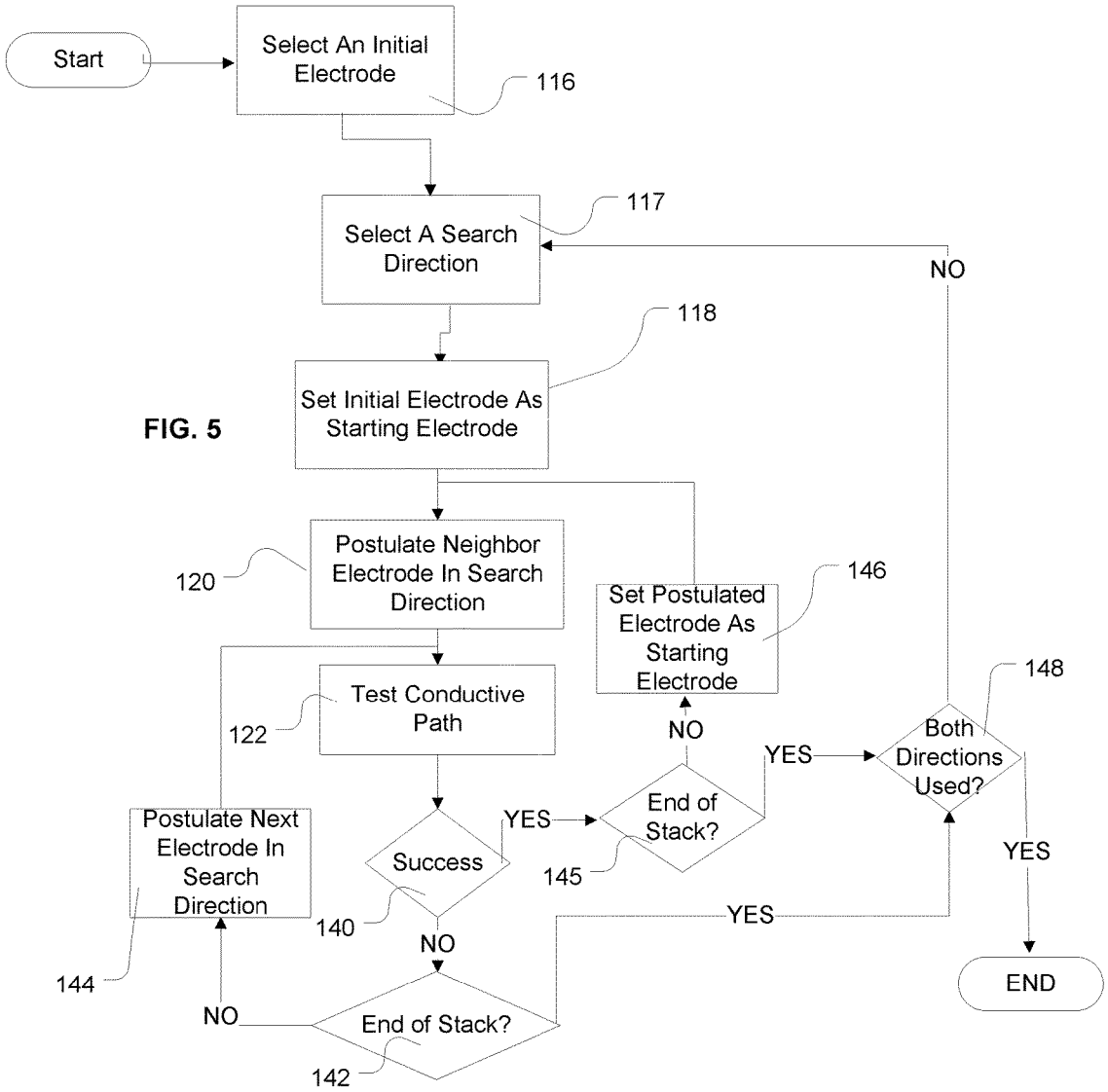
FIG. 5 is a flow chart depicting a routine constituting one step of the process shown in FIG. 4.

The routine used in step 114 is shown in FIG. 5. At step 116 of this routine, the controller selects an initial electrode which will be used in the search. In this embodiment, the initial electrode is chosen by a substantially random selection. For example, the controller can run a conventional routine for generating a random or pseudorandom number within a range equal to the range of ordinal numbers for the electrodes, and selects as the initial electrode then electrode having the ordinal number closest to the random number. Thus, for the heater depicted in FIG. 1, with 29 electrodes, the random number would be between 1 and 29. For example, if the random number is 6.2, the routine selects electrode 14(6) as the initial electrode.

At step 117, the routine selects a search direction, i.e., either the first stack direction from the initial electrode toward the first end of the stack at electrode 14(1) or the second stack direction, toward the second end of the stack at electrode 14(29). This selection is arbitrary, and may also be based on a random or pseudorandom number.

The routine then sets the initial electrode as a starting electrode for a postulated conduction path, i.e., as one live electrode of the path (step 118), to be connected to the hot pole of the power supply. In step 120, the routine postulates the electrode neighboring the starting electrode, but offset from the starting electrode in the search direction, as the other live electrode of the conduction path, to be connected to the neutral pole of the power supply. For example, if electrode 14(6) is the starting electrode and the search direction is the first direction, electrode 14(5) would be the postulated electrode.

Figure 6:
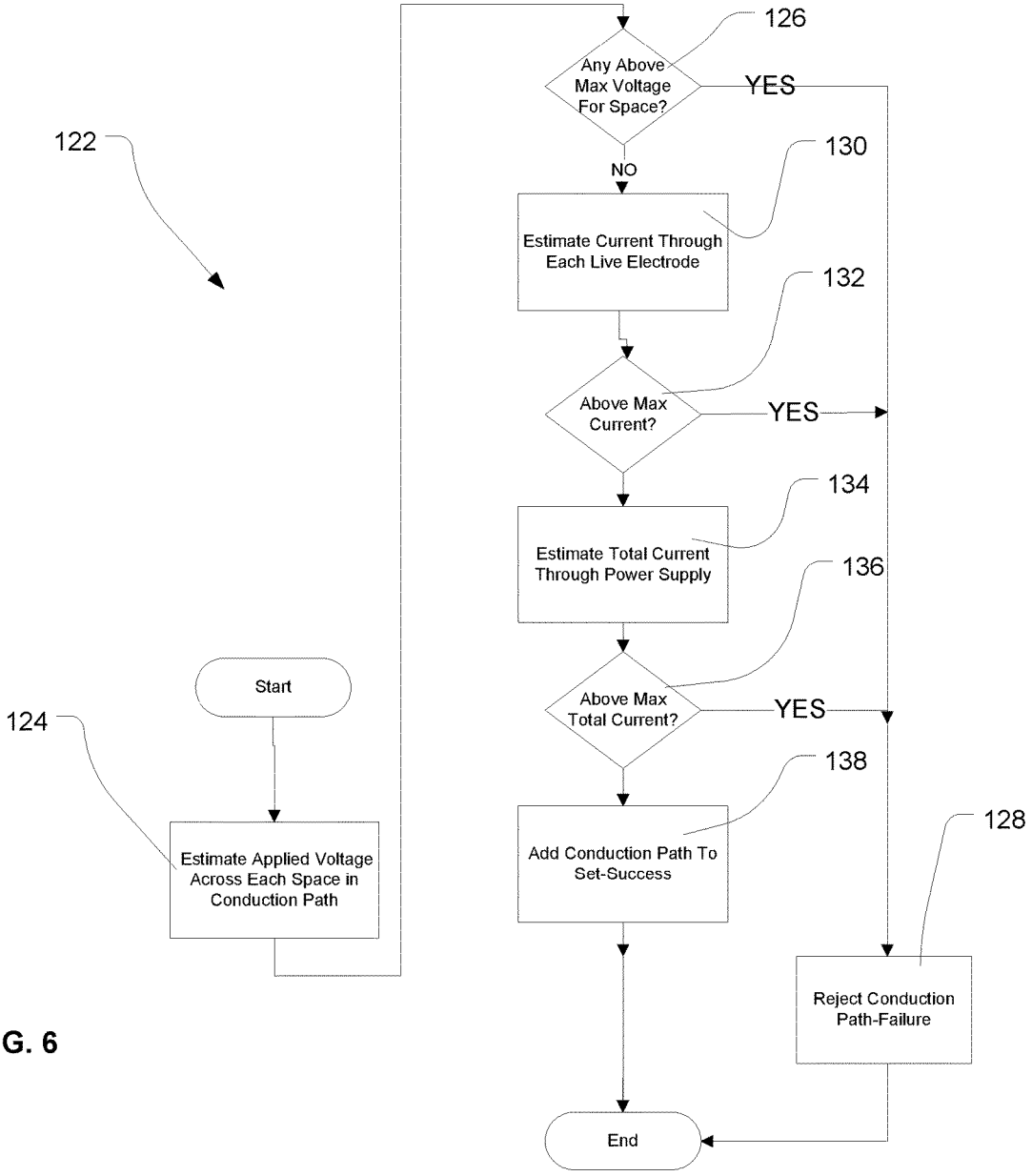
FIG. 6 is a further flow chart depicting a routine constituting one step of the routine shown FIG. 5.

In step 122, the routine then tests the postulated conduction path using the routine shown in FIG. 6. In step 124 of this routine, the controller estimates the voltage which would be applied across each space within the conduction path. In the example discussed above, where the conduction path includes only two live electrodes and one space, the estimated voltage across this space is simply the full voltage applied between the poles of the power supply. However, if the postulated conduction path includes one or more isolated electrodes and two or more spaces as discussed below, the controller models the conduction path as a series circuit. In this modeling step, the resistance of each space is the resistance of that space as estimated in step 110 discussed above. The resistances of the spaces in the conduction path are modeled as connected in series through the isolated electrode or electrodes. The voltage at each isolated electrode will have a value between the hot and neutral voltages of the power supply, and the voltage appearing across each space will be lower than the full voltage of the power supply. In the series model, the estimated voltage across each space will be the product of the full voltage applied by the power supply and the resistance across the space, divided by the sum of the resistances across all of the spaces in the postulated conduction path.

In step 126, the controller compares the estimated voltage for each space in the postulated conduction path with the maximum voltage for that space, as determined in step 112 (FIG. 4). If such comparison indicates that, for any space in the path, the estimated voltage exceeds the maximum voltage for that space, the routine rejects the path, (Step 128).

If not, the routine passes to step 130 and estimates the current through each live electrode, i.e., through the starting electrode and the postulated electrode, and thus estimates the current passing through the power switch which will connect that electrode with the power supply. The routine first computes an estimate of the current which will pass between these electrodes through the postulated conduction path. This estimated current is found by dividing the full voltage of the power supply by the sum of the resistances across all of the spaces included in the conduction path. If the postulated conduction path incorporating the starting electrode and postulated electrode is the only conduction path incorporating these electrodes, the estimated current through each live electrode is equal to the current through the postulated conduction path. As explained below, some of the live electrodes will be included in two distinct conduction paths. If the postulated electrode or the starting electrode has been included as a live electrode in another conduction path which has already been accepted and included in the set of conduction paths to be actuated, the routine adds the estimated current for the postulated conduction path to the estimated current for the other conduction path to arrive at the total current for that electrode. If the total current is above the maximum current for the electrode, i.e., above the current rating of the power switch associated with the electrode (Step 132), the routine passes to step 128 and rejects the postulated conduction path.

If not, the routine estimates the total current which will be drawn from the power supply during the actuation interval by adding the estimated current through the postulated conduction path to the estimated currents through any previously-accepted conduction paths included in the set of conduction paths to be actuated (Step 134). The estimated total current is compared with the maximum current for the power supply (Step 136). If the estimated total current exceeds the maximum current for the power supply, the routine rejects the postulated conduction path (Step 128). If not, the test routine accepts the postulated conduction path as meeting all of the constraints, and adds the conduction path to the set of conduction paths for the actuation interval (Step 138). After step 128 or step 138, the test routine 122 is complete, and the system passes to step 140 of the path selection routine (FIG. 5).

If step 122 failed to add the postulated conduction path, the selection routine determines if the postulated electrode was disposed at an end of the stack disposed in the search direction from the starting electrode, i.e., if electrode 14(1) was the postulated electrode, assuming that the first direction is the search direction. (Step 142). If not, the system selects the next electrode, further from the starting electrode in the search direction, as the postulated electrode to form a conduction path with the starting electrode (Step 144) so as to postulate a new conduction path, and repeats the testing step 122. In the example discussed above, where electrode 14(6) was selected as the starting electrode, and neighboring electrode 14(5) was postulated as the other live electrode for a conduction path and tested in step 122, failure in the test routine 122 will cause step 144 to postulate a new conduction path including the same starting electrode 14(6) as one live electrode, electrode 14(4) as the other live electrode, and electrode 14(5) as an isolated electrode. If this path also fails in step 122, the selection routine will postulate yet another conduction path, with live electrodes 14(6) and 14(3) and isolated electrodes 14(5) and 14(4). This continues until either the test succeeds or a test with the starting electrode 14(6) and postulated electrode 14(1) at the end of the stack fails in step 122. Stated another way, the selection routine responds to failure of a postulated conduction path by search for a longer conduction path, which will have lower applied voltages in each space and a lower current.

If a postulated conduction path passes step 122 and is added to the set of electrodes to be actuated, the selection routine passes to step 145, and again checks whether the postulated electrode in that conduction path was at an end of the stack, i.e., whether the postulated electrode was electrode 14(1) if the search direction was the first direction. If not, this indicates that there are electrodes and spaces remaining between the last accepted conduction path and the end of the stack. The selection routine passes to step 146, and sets the postulated electrode used in the last accepted conduction path as a new starting electrode. For example, if a conduction path with starting electrode 14(6) connected to the hot pole and postulated electrode 14(3) connected to the neutral has successfully passed the test routine in step 122, the selection routine will set electrode 14(3) as the starting electrode, connected to the neutral pole. The selection routine uses the steps discussed above in an attempt to find another conduction path. In the same example, the routine will first postulate the neighboring electrode 14(2) disposed in the first direction from starting electrode 14(3) as a live electrode to be connected to the hot pole of the power supply. If this postulated path fails in step 122, the routine will postulate a new conduction path incorporating electrode 14(1).

In this manner, the selection routine searches for conduction paths disposed in the search direction from the initial electrode selected in step 116. When the routine reaches the end of the stack in the search direction, either in step 142 or step 144, the search in this direction is complete. The routine then checks if both search directions have been used (step 148). If not, the selection routine returns to step 117 and selects the opposite search direction and searches for acceptable conduction paths disposed in the new search direction from the initial electrode. This search is conducted in exactly the same manner as discussed above. When both search directions have been used, the set of conduction paths is complete, the selection routine 114 (FIGS. 4 and 5) ends. At this stage of the process, the controller has stored the set of all of the conduction paths to be used in the upcoming actuation interval, including the identities of electrodes to be connected to the hot and neutral poles of the power supply.

At the inception of the next actuation interval, the controller operates power switches 48 (FIG. 3) to change the connections between electrodes 14 and the poles 38 and 40 of power supply 36 from the connections used in the last previous actuation interval to the pattern of connections needed to form only the set of conduction paths selected in step 114. Where power supply 36 provides an alternating voltage, the beginning and end of each actuation interval desirably occurs at or near a zero-crossing point of the alternating voltage. Thus, each actuation interval desirably has a duration equal to an integral number of half-cycles of the power supply voltage. For example, each actuation interval may be $1/60^{th}$ of a second, corresponding to one full cycle of the power supply voltage. The controller may include an internal clock (not shown) for timing the actuation intervals, such clock being synchronized with the power supply voltage. For example, the controller may use a phase-locked loop or other conventional element for comparing the timing of the internal clock with the power supply voltage and adjusting the internal clock accordingly.

During the actuation interval, the controller takes in measured data from the temperature sensors 61, 63 and 65 (FIG. 1) and from the current sensor 80 associated with the power source, and compares this data to expected values. (Step 152) For example, the total current passing through the power supply, as measured by sensor 80, may be compared with the expected value of total current, i.e., the sum of the estimated currents for the conduction paths in use. The temperature of the fluid at intermediate temperature sensor 63 and at exit sensor 65 may be compared with the estimated temperature for the fluid elements positioned at these sensors during the actuation interval.

In step 154, the controller determines the positions which the fluid elements will have at the beginning of the next actuation interval, based on the flow rate as measured by flowmeter 67.

In step 156, the controller estimates the temperature which each fluid element will have at the end of the actuation interval which began at step 150. For each fluid element disposed within a space included in a conduction path actuated during the interval, a first estimate Tend1 of this ending temperature is given by:

$$T_{end1}=T_{begin}+K_2(E_{est})^2/R_{est}$$

Where:

$T_{begin}$ is the estimated temperature of the fluid element at the beginning of the actuation interval;

$E_{est}$ is the estimated voltage between the electrodes bounding the space, as determined in step 124 (FIG. 6);

$R_{est}$ is the estimated electrical resistance of the fluid element disposed in the space at the beginning of the actuation interval; and $K_2$ is a constant equal to the duration of the actuation interval divided by the product of the specific heat and mass of the fluid element.

$T_{end1}$ thus represents the effect of the electrical power dissipation within each fluid element. Thus, for those fluid elements which are disposed outside of the actuated conductive paths, $T_{end1}$ is equal to $T_{begin}$. The first estimate $T_{end1}$ desirably is further adjusted to take account of heat transfer between adjacent fluid elements, such as by conduction and mixing. For any fluid element 100*n* (FIG. 1), heat is transferred to or from the immediately adjacent elements 100(*n*−1) and 100(*n*+1) in the sequence. Thus, an adjusted estimate $T_{end2}(n)$ of element 100*n* is given by:

$$T_{end2}(n)=T_{end1}(n)+K_3(T_{end1}(n-1)-T_{end1}(n))+K_3(T_{end1}(n+1)-T_{end1}(n))$$

Where:

$K_3$ is a constant, commonly referred to as a "diffusion constant"; and $T_{end1}(n-1)$ and $T_{end1}(n+1)$ are the first estimated temperatures of the adjacent fluid elements.

Once the adjusted estimated temperatures $T_{end2}$ have been determined for all of the fluid elements, the controller passes to step 158, in which the parameters used by the controller can be adjusted as discussed further below. This step need not occur in every cycle. Following step 158, if used, the controller passes back to step 110. It should be appreciated that the operations discussed with reference to FIG. 4 repeat continually. Thus, after the inception of one actuation interval in step 150, the controller executes steps 152-158 and 110-114 before that actuation interval ends. In this cycle of operations, the estimated beginning temperatures of the fluid elements used to set the conduction paths for a given actuation interval are based on estimated ending temperatures for the next previous actuation interval.

It should be noted that the control system, operated as discussed above, does not explicitly attempt to find an overall heating rate for the entire heater which will bring the incoming fluid to the desired setpoint temperature. Rather, the control system attempts, in each cycle, to find combinations of electrodes which will contribute heat to the fluid without heating any part of the fluid above the setpoint temperature. The finite element control system uses the history of each fluid element, as reflected in its estimated temperature, as part of the control scheme. Although the present invention is not limited by any theory of operation, it is believed that this contributes to the ability of the control system to respond rapidly to changes in operating conditions such as changes in flow rate or conductivity, or changes in the set point temperature.

In step 158, the controller examines the results of the comparison of measured temperatures and currents with corresponding estimated values obtained in step 152, and adjusts one or more of the parameters used in the model based on these results. The examination may include comparison results obtained in a plurality of cycles. For example comparison results for several cycles may be averaged. In one simple example, if the measured current at the power supply is consistently below the estimated value, the controller may reduce the baseline conductivity used in the model. In a further example, if the measured values of temperature indicate that the temperature rise in the fluid from the inlet sensor 61 to the outlet sensor 65 is consistently below the expected value, and the current data indicates that the baseline conductivity used in the model is accurate, this indicates that the flow through the heater is greater than that indicated by the flowmeter. To compensate for this, the controller may apply a correction factor or offset to the flow rate in future cycles. Alternatively, the controller may reduce the conductivity values used in the model. This will cause the model to select conduction paths which apply higher voltages across the spaces, and thus increase the heating effect. The controller can make similar adjustments based on comparison between the measured temperature rise from the inlet sensor 61 to intermediate sensor 63 and the predicated temperature rise for the same fluid path. The relatively short fluid path length between the inlet and intermediate sensors provides a faster response time for the adjustment. Similar adjustments can be made based on comparison using the fluid path from intermediate sensor 63 to outlet sensor 65.

The embodiment discussed above can be varied in many ways. For example, more electrodes or fewer electrodes can be used. Also, it is not essential to provide measuring instruments to measure flowrate, fluid temperatures and currents. For example, if the fluid is supplied to the heater by a positive-displacement pump or under a constant head, the flow rate may be known. Likewise, where the conductivity of the fluid is well controlled and known, it need not be measured.

The conduction path selection routine discussed above with reference to FIGS. 5 and 6 uses a random selection of an initial electrode and a bi-direction search through the stack for acceptable conduction paths. The random selection of the initial electrode typically causes the selection routine to select different conduction paths during different actuation intervals, even when the heater is operating under constant conditions. This is desirable in that it sends current through different ones of the power switches. This helps to avoid overheating of the individual power switches, which is particularly desirable with semiconductor power switches. In other embodiments, the path selection routine may be set to always start from an initial electrode at one end of the stack and to search for acceptable conduction paths in only one direction. Indeed, it is not essential to search for acceptable conduction paths in any particular order; the system may simple postulate conduction paths at random.

In the conduction path selection routine discussed above, the constraint that the total power drawn from the power supply is applied during the step of testing each postulated conduction path, without regard for the location of the conduction path within the heater. In a variant, the selection routine may select a preliminary set of conduction paths without regard for this constraint, and then apply this constraint by deleting conduction paths according to a priority based upon location of the path until the total current constraint is met. For example, the deletion scheme may be biased so as to retain those conduction paths closest to the outlet of the heater while deleting conduction paths further from the outlet. In a further variant, this constraint may be entirely omitted. For example, the power supply may have a capacity greater than the maximum total current that can be drawn by any combination of conduction paths.

In the embodiments discussed above, the maximum fluid temperature is applied as a constraint in selection of the conduction paths by setting the maximum voltage for each space. In a variant, the highest estimated fluid element temperature for each space in each postulated conduction path can be calculated explicitly, after estimating the applied voltage across the spaces in the conduction path, and the conduction path can be rejected if this highest estimated fluid element temperature exceeds the maximum temperature. In a further variant, the effects of heat transfer between adjacent elements can be taken into effect in the calculations used to set the maximum voltage for each space or to determine the highest estimated fluid element temperature.

In the embodiments discussed above, the maximum fluid element temperature used in selection of conduction paths is the set point temperature, and is uniform throughout the heater. In other embodiments, the maximum fluid element temperature may be different in different portions of the heater as, for example, slightly higher in portions of the heater remote from the outlet.

In the embodiments discussed above, the electrodes are arranged in the stack, and the flow of fluid moves the fluid in a direction corresponding to one direction through the stack. However, the electrodes need not be arranged in a stack, and the baffles and internal passages of the heater may be arranged to route the fluid through the spaces in any order, so long as that order is accounted for in the model.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. A heater for heating an electrically conductive fluid comprising:

(a) a structure;

(b) a plurality of electrodes mounted to the structure with spaces between neighboring ones of the electrodes, the structure being adapted to direct fluid flowing through the heater in a downstream direction along a predetermined flow path extending through the spaces, so that fluid in the spaces contacts the electrodes and electrically connects neighboring electrodes to one another, (c) an electrical power supply having at least two poles, the power supply being operable to supply different electrical potentials to different ones of the poles;

(d) power switches electrically connected between at least some of the electrodes and the poles, the power switches being operable to selectively connect the electrodes to the poles and to selectively disconnect electrodes from the poles so as to form conduction paths, each including two live electrodes connected to different poles of the power supply and fluid in at least one of the spaces;

(e) a controller configured to control operation of the power switches by cyclically operating a model in which the fluid is modeled as a series of fluid elements passing through the spaces at a speed based on a flow rate of the fluid through the heater, each cycle including the steps of:

(i) modeling operation of different ones of the conduction paths for an actuation interval having a beginning and an end, the modeling step being conducted so as to select conduction paths for actuation during the actuation interval such that actuation of the selected conduction paths will not violate a set of constraints including a maximum temperature for each fluid element at the end of the actuation interval and a maximum current through each live electrode, the modeling using estimated beginning temperatures and conductivities for individual ones of the fluid elements at the beginning of the actuation interval; and then (ii) actuating the power switches to connect only the live electrodes of the selected conduction paths to the power supply at the beginning of the actuation interval; and (iii) using the finite element model, predicting ending temperatures for the individual ones of the fluid elements at the end of the actuation interval, wherein the estimated beginning temperatures of the fluid elements used in each cycle are determined based at least in part on the ending temperatures for the same fluid elements predicted in a previous cycle.

2. A heater as claimed in claim 1 wherein at least one of the conduction paths includes one or more isolated electrodes disconnected from the poles and fluid in at least two of the spaces so that the live electrodes of such conduction path are electrically connected to one another through the spaces and the one or more isolated electrodes.

3. A heater as claimed in claim 2 wherein the modeling for each conduction path includes setting a maximum voltage for each pair of mutually-adjacent electrodes included in the conduction path by considering each fluid element disposed in the space between the pair of electrodes and determining a maximum voltage which can be applied across such fluid element without raising the temperature of that fluid element above the maximum temperature, and setting the maximum voltage for the pair based on a lowest maximum voltage determined for any one of the fluid elements disposed in the space between the pair.

4. A heater as claimed in claim 3 wherein the determination whether each conduction path can be actuated in an actuation interval includes determining that a conduction path cannot be actuated if actuation of the conduction path would result in application of a voltage across any pair of mutually-adjacent electrodes included in the conduction path which is higher than the maximum voltage for that pair.

5. A heater as claimed in claim 4 wherein the modeling for each conduction path includes calculating an electrical resistance across the space between each pair of mutually-adjacent electrodes included in the conduction path based on the resistances of the fluid elements disposed in the space considered in parallel.

6. A heater as claimed in claim 5 wherein, for each conduction path including one or more isolated electrodes, the modeling includes determining a voltage at each one of the isolated electrodes included in the conduction path.

7. A heater as claimed in claim 2 wherein the electrodes are arranged in a stack extending in first and second stack directions, and wherein, in each cycle, the step of modeling operation of different ones of the conduction paths includes designating one of the electrodes as a first starting electrode and performing a search routine of repeatedly modeling operation of conduction paths including the starting electrode as one live electrode and another one of the electrodes offset from the starting electrode in a selected one of the stack directions as a postulated live electrode using a different postulated electrode further from the stack electrode in each repetition until either (1) a successful result is reached in which the conduction path between the starting electrode and the postulated electrode is selected as meeting the constraints or (2) an unsuccessful result is reaching in which modeling of a conduction path including the starting electrode and the electrode furthest from the starting electrode in the selected stack direction as the postulated indicates that such conduction path does not meet the constraints.

8. A heater as claimed in claim 7 wherein, in each cycle, the step of modeling operations of different ones of the conduction paths includes designating a postulated electrode which yields a positive result in the search routine as a new starting electrode and repeating the search routine using the same stack direction.

9. A heater as claimed in claim 7 wherein, in each cycle, the step of modeling operations of different ones of the conduction paths includes repeating the search routine using the first starting electrode and a selected stack direction opposite to the previously-selected stack direction.

10. A heater as claimed in claim 7 wherein the controller is configured to designate different ones of the electrodes as the first starting electrode in different cycles.

11. A heater as claimed in claim 1 wherein the controller is configured to select the conduction paths in each cycle so that a predicted total current flowing between the poles of the power supply during the actuation interval does not exceed a maximum total current.

12. A heater as claimed in claim 1 wherein the controller includes an input for receipt of a set point temperature, the controller being configured to use the set point temperature as the maximum temperature used in each cycle.

13. A heater as claimed in claim 1 further comprising a flowmeter connected to the controller, the controller being configured to set the flow rate of the fluid responsive to data supplied by the flowmeter.

14. A heater as claimed in claim 1 further comprising an inlet thermometer operative to measure an inlet temperature of fluid entering the flow path, the controller being configured to estimate the beginning temperatures of the fluid elements based in part upon the inlet temperature.

15. A heater as claimed in claim 14 further comprising an additional thermometer operative to measure a temperature of fluid at a location along the flow path downstream from at least one of the spaces, the controller being operative to adjust at least one parameter used in modeling of the fluid elements responsive to the temperature of the fluid measured by the additional thermometer.

16. A heater as claimed in claim 1 further comprising a conductivity measuring instrument operative to measure electrical conductivity of fluid passing along the flow path, the controller being configured to estimate conductivity of the fluid based at least in part on the measured conductivity.

17. A heater as claimed in claim 16 wherein, in each cycle, the controller is configured to estimate the conductivity of the fluid in each fluid element based in part on the estimated beginning temperature of that fluid element.

18. A heater as claimed in claim 1 wherein the controller is configured to estimate the estimated beginning temperatures of the fluid elements for each cycle based in part upon the predicted ending temperatures of the fluid elements for the previous cycle and in part on an estimate of heat diffusion between adjacent fluid elements having different temperatures.

19. A method of heating an electrically conductive fluid in a heater, the method comprising:

(a) passing the fluid along a predetermined flow path extending through spaces between neighboring electrodes so that fluid in the spaces contacts the electrodes and electrically connects neighboring electrodes to one another;

(b) cyclically operating a model in which the fluid is modeled as a series of fluid elements passing through the spaces at a speed based on a flow rate of the fluid through the heater, each cycle including the steps of:

(i) modeling operation of different ones of conduction paths, each such conductive path including two of the electrodes as live electrodes connected to different electrical potentials and fluid in at least one of the spaces, for an actuation interval having a beginning and an end;

to select conduction paths which for actuation in the actuation interval such that actuation of the selected conduction paths will not violate a set of constraints including a maximum temperature for each fluid element and a maximum current through each live electrode, the modeling using estimated beginning temperatures and conductivities for individual ones of the fluid elements; and then (ii) connecting the live electrodes of only the selected conduction paths to a power supply at the beginning of the actuation interval; and (iii) using the finite element model, predicting ending temperatures for individual ones of the fluid elements at the end of the actuation interval;

wherein the estimated beginning temperatures of the fluid elements used in each cycle are determined based at least in part on the ending temperatures for the same fluid elements predicted in a previous cycle.

20. A method as claimed in claim 19 wherein at least one of the conduction paths includes one or more isolated electrodes disconnected from the poles and fluid in at least two of the spaces so that the live electrodes of such conduction path are electrically connected to one another through the spaces and the one or more isolated electrodes.

21. A method as claimed in claim 20 wherein step (b)(i) includes, for each conduction path, setting a maximum voltage for each pair of mutually-adjacent electrodes included in the conduction path by considering individual ones of the fluid elements disposed in the space between the pair of electrodes and determining a maximum voltage which can be applied across each such fluid element without raising the temperature of that fluid element above the maximum temperature, and setting the maximum voltage for the pair based on a lowest maximum voltage determined for any one of the fluid elements disposed in the space between the pair.

22. A method as claimed in claim 21 step (b)(i) includes determining that a conduction path will not be selected if actuation of the conduction path would result in application of a voltage across any pair of mutually-adjacent electrodes included in the conduction path which is higher than the maximum voltage for that pair.

23. A method as claimed in claim 22 wherein step (b)(i) includes calculating an electrical resistance across the space between each pair of mutually-adjacent electrodes based on the resistances of the fluid elements disposed in the space considered in parallel.

24. A method as claimed in claim 6 wherein step (b)(i) includes, for each conduction path including one or more isolated electrodes, determining a voltage at each one of the isolated electrodes included in the conduction path.

25. A method as claimed in claim 19 wherein the maximum temperature used in each cycle corresponds to a set point temperature representing a desired temperature of fluid passing out of the heater.

26. A method as claimed in claim 19 further comprising measuring a temperature of fluid at a location along the flow path downstream from at least one of the spaces, and adjusting at least one parameter of the finite element model responsive to the measured temperature.

27. A method as claimed in claim 19 further comprising measuring electrical conductivity of fluid passing along the flow path and estimating conductivity of the fluid and, in each cycle, estimating the conductivity of the fluid in each individual one of the fluid elements based in part on the measured conductivity and in part on the estimated beginning temperature of each individual one of the fluid elements.

28. A method as claimed in claim 19 the estimated beginning temperatures of the fluid elements for each cycle are based in part upon the predicted ending temperatures of the fluid elements for the previous cycle and in part on an estimate of heat diffusion between adjacent fluid elements having different temperatures.

* * * * *